US006578926B2

(12) United States Patent
Bandy, Jr. et al.

(10) Patent No.: US 6,578,926 B2
(45) Date of Patent: Jun. 17, 2003

(54) MINING MACHINE HAVING STABILIZING APPARATUS AND STABILIZING APPARATUS

(75) Inventors: Clarence L. Bandy, Jr., Glade Spring, VA (US); Kenneth A. Neely, Blacksburg, VA (US)

(73) Assignee: Eimco LLC, Bluefield, WV (US)

( * ) Notice: Subject to any disclaimer, the term of this patent is extended or adjusted under 35 U.S.C. 154(b) by 0 days.

(21) Appl. No.: 09/881,730

(22) Filed: Jun. 18, 2001

(65) Prior Publication Data

US 2002/0190567 A1 Dec. 19, 2002

(51) Int. Cl.[7] ..... E21C 29/22

(52) U.S. Cl. ..... 299/64; 299/18; 299/31; 299/33

(58) Field of Search ..... 198/302; 180/9.32, 180/9.28, 9.1, 11; 280/763.1, 764.1; 299/31, 33, 18, 43, 56, 64, 67

(56) References Cited

U.S. PATENT DOCUMENTS

| | | | | | |
|---|---|---|---|---|---|
| 3,095,080 A | * | 6/1963 | Wagner | ..... | 198/302 |
| 4,281,879 A | | 8/1981 | LeBegue et al. | | |
| 4,657,099 A | * | 4/1987 | Baltensperger | ..... | 180/9.28 |
| 5,192,115 A | * | 3/1993 | Hartman et al. | ..... | 299/31 |

* cited by examiner

*Primary Examiner*—Heather Shackelford
*Assistant Examiner*—Sunil Singh
(74) *Attorney, Agent, or Firm*—Burns, Doane, Swecker & Mathis, LLP

(57) ABSTRACT

A mining machine having a stabilizing apparatus includes a mining machine and a stabilizing apparatus attached to the mining machine. The stabilizing apparatus includes a stabilizing element and a moving arm attached to the stabilizing element and the mining machine for raising the stabilizing element above and lowering the stabilizing element into contact with a mine floor.

31 Claims, 4 Drawing Sheets

MINING MACHINE HAVING STABILIZING APPARATUS AND STABILIZING APPARATUS

A mining machine of the type having a rotating cutter drum at a front end thereof can become unstable when the cutter drum is pivoted downwardly relative to the main body portion of the mining machine during the mining operation. This downward pivoting of the cutter drum while the drum is in contact with the earth is often called shearing. When the cutter drum pivots downwardly, the body of the mining machine may tend to lift up from the ground and pivot about the rear end of the crawler tracks.

In the past, a stabilizing arm was connected to the mining machine body and would be pivoted downwardly with sufficient force to embed in the mine floor and thereby anchor the mining machine body so that the mining machine would tend to pivot about the stabilizing arm instead of the crawler tracks. Prior art arrangements suffered from disadvantages including difficulty in arranging piston cylinders and the stabilizing arm in a space beneath a conveyor of the mining machine so that the arm could be brought into contact with the mine floor with sufficient force. U.S. Pat. No. 4,281,879, which is incorporated by reference, discloses a stabilizing assembly that is designed to pivot a stabilizing arm so that a ground engaging arm is brought into contact with the mine floor. By this design, the stabilizing arm will slide along the mine floor as the mining machine sumps forward. This sliding action reducers the available forward thrust. Also, as the machine sumps, the drum rotation offsets the weight of the front of the machine and makes the front of the machine seem lighter, thus transferring the machine's center of gravity toward the back of the machine. This causes a reduction in the tractive effort because the full length of the crawler chain is no longer in contact with the mine floor during this dynamic situation.

In all prior art designs of mining machines having stabilizing assemblies, whether the stabilizing assembly is of the type that embeds in the ground or otherwise, when the cutter drum shears downwardly as it cuts into particularly hard material, the entire machine tends to try to push backward. It is desirable to provide a stabilizer assembly and a mining machine with a stabilizing assembly that is better suited for preventing backward movement of the mining machine as the cutter drum shears downwardly.

In accordance with one aspect of the present invention, a mining machine having a stabilizing apparatus includes a mining machine and a stabilizing apparatus attached to the mining machine. The stabilizing apparatus includes a turnable stabilizing element and a moving arm attached to the turnable stabilizing element and the mining machine for raising the turnable stabilizing element above and lowering the turnable stabilizing element into contact with a mine floor.

In accordance with another aspect of the present invention, a stabilizing apparatus for a mining machine includes a turnable stabilizing element and a movable arm attached at a first end to the turnable stabilizing element and attachable at a second end to a mining machine for raising the turnable stabilizing element above and lowering the turnable stabilizing element into contact with a mine floor.

In accordance with yet another aspect of the present invention, a mining machine having a stabilizing apparatus includes a mining machine and a stabilizing apparatus attached to the mining machine, the stabilizing apparatus including a stabilizing shoe portion. A piston arrangement is disposed between the stabilizing apparatus and a body of the mining machine. The piston arrangement is adapted to move the stabilizing shoe toward a rear of the body.

BRIEF DESCRIPTION OF THE DRAWINGS

The features and advantages of the present invention are well understood by reading the following detailed description in conjunction with the drawings in which like numerals indicate similar elements and in which.

DETAILED DESCRIPTION

Figure 1A:
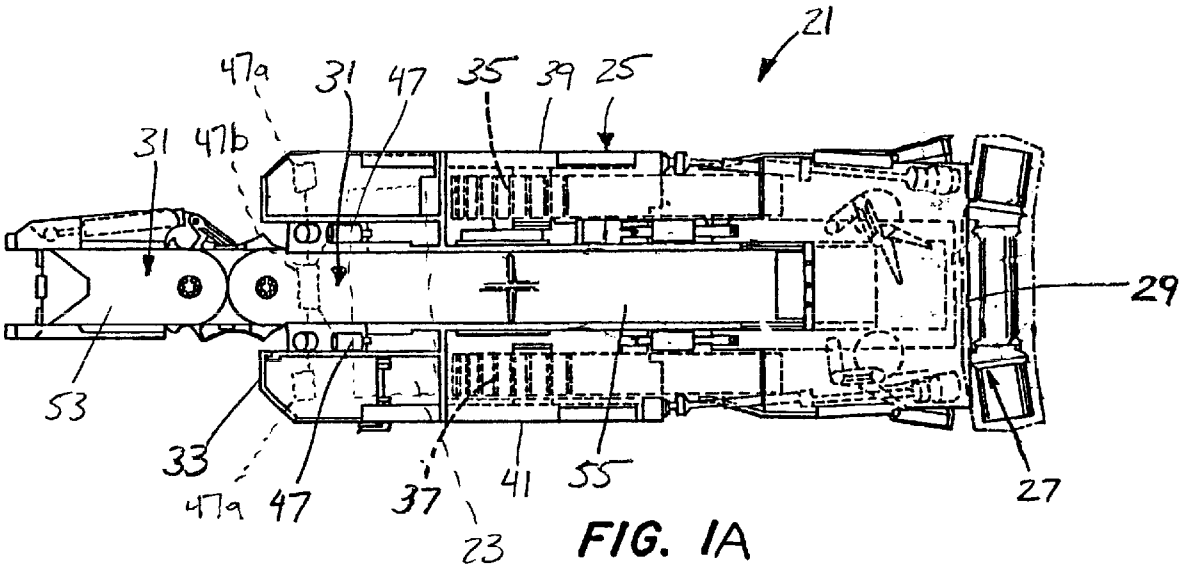
FIGS. 1A and 1B are top and right side views of a mining machine having a stabilizing apparatus according to an embodiment of the present invention.
Figure 1B:
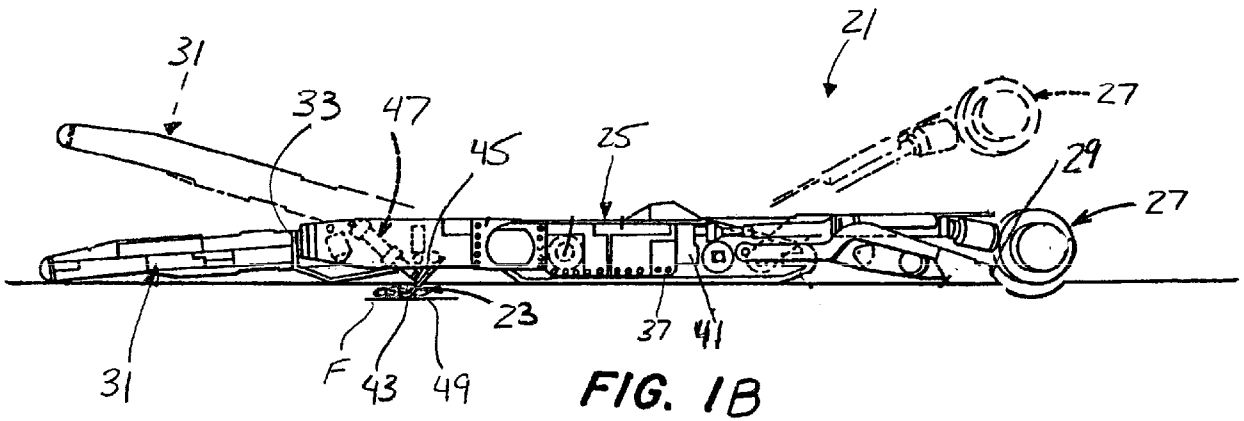

A mining machine 21 having a stabilizing apparatus 23 according to an embodiment of the present invention is shown in FIGS. 1A and 1B. The mining machine 21 is preferably an otherwise conventional mining machine, such as the mining machine disclosed in U.S. Pat. No. 4,281,879, which is incorporated by reference, and includes a mining machine body portion 25 and, preferably a vertically movable cutter drum assembly 27 pivotably attached at a front end 29 of the body portion 25. A conveyor assembly 31 is preferably provided, with a portion thereof being pivotably attached at a rear end 33 of the body portion. Left and right endless track assemblies 35, 37 are preferably disposed at left and right sides 39, 41 of the body portion 25.

The stabilizing apparatus 23 is attached to the mining machine 21 and preferably includes a turnable stabilizing element 43, as seen in FIG. 1A. For purposes of the present application, except where otherwise indicated, a turnable stabilizing element means a stabilizing element having a member that is capable of turning, such as about an axle or axles, such as a wheel, an endless track, a drum, or similar members. The stabilizing apparatus 23 also preferably includes a moving arm 45 attached to the turnable stabilizing element 43 and the body portion 25. The moving arm 45 is used for raising the turnable stabilizing element 43 above and lowering the turnable stabilizing element into contact with a mine floor F. The moving arm 45 is preferably pivotably attached at a first end 46 to the mining machine 21, preferably to the body portion 25. If desired or necessary, however, the moving arm may be movable relative to the mining machine 21 in some other fashion, such as by being telescopic or movable by means of cam or piston arrangements. Preferably, the moving arm 45 includes a control system 47 for causing the arm to move, preferably by causing the arm to pivot in a vertical direction about a substantially horizontal axis about its first end 46. The control system 47 is preferably hydraulically operated and, more particularly, includes a hydraulic piston and cylinder arrangement.

Figure 4:
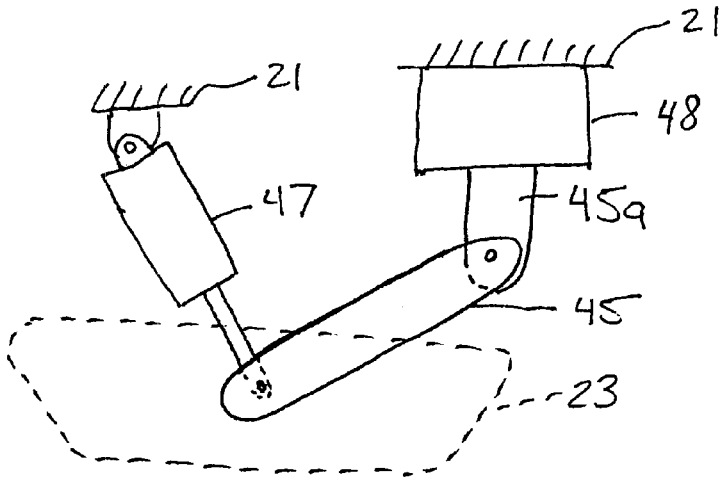
FIG. 4 schematically shows a mining machine having a stabilizing apparatus according to an embodiment of the present invention together with a steering arrangement.

An alternative embodiment wherein the stabilizing apparatus 23 is steerable is shown in phantom in FIG. 4. The mining machine 21 is provided with a steering arrangement 48 for the stabilizing apparatus 23 such as, for example, a roller-cam steering gear or a recirculating-ball steering gear. The arm or arms 45 are preferably connected to the steering arrangement by a suitable structure such as a pivot trunion 45*a*. When it is desired to steer the mining machine 21, such as when it is desired to turn the machine around corners, the stabilizing element 23 is pivoted relative to the body 25 of the mining machine to facilitate the turning operation.

The control system 47 can be caused to retract the stabilizing apparatus 23 toward the body 25 when an unbalanced condition is sensed on the mining machine 21. As seen in phantom in FIG. 1A, one or more suitable sensors 47*a* can be provided on the mining machine 21 and can be connected to send a signal to a controller 47*b* such as a computer that operates the control system 47. When the sensors 47*a* sense a condition such as excessive tilting of the mining machine 21, the sensors send a signal to the controller 47*b* which then controls the control system 47 to withdraw the stabilizing apparatus 23.

In the embodiment shown in FIG. 1, the turnable stabilizing element 43 includes at least one, preferably two, endless crawler tracks 49 attached at a second end 50 of the moving arm 45. The crawler track 49 is preferably pivotable relative to the moving arm 45 so that, when the arm is lowered to move the crawler track into contact with the floor F, the crawler track is in contact with the floor over a substantial portion of its length.

According to one embodiment, a drive 51 is arranged to drive the crawler track. The drive 51 may be a dedicated drive for driving the crawler track 49, or the crawler track may be driven under power from a main drive for the mining machine 21. By providing a driven crawler track 49, the crawler track provides the advantage of adding to the forward directed thrust of the mining machine to counteract the backward directed forces resulting from downward movement of the cutter drum into hard material. The drive 51 may, if desired or necessary, be operated only while the cutter drum is in a downward shearing mode. When the drive 51 is not operated, the crawler track 49 is preferably provided with an arrangement, such as a sprag clutch 57, to prevent reverse turning of the crawler track. The crawler track 49 may also include outwardly extending teeth 59 to assist in advancing and/or preventing reverse movement of the mining machine 21. The drive and/or the reverse turning arrangement can, if desired or necessary, be omitted.

Figure 2A:
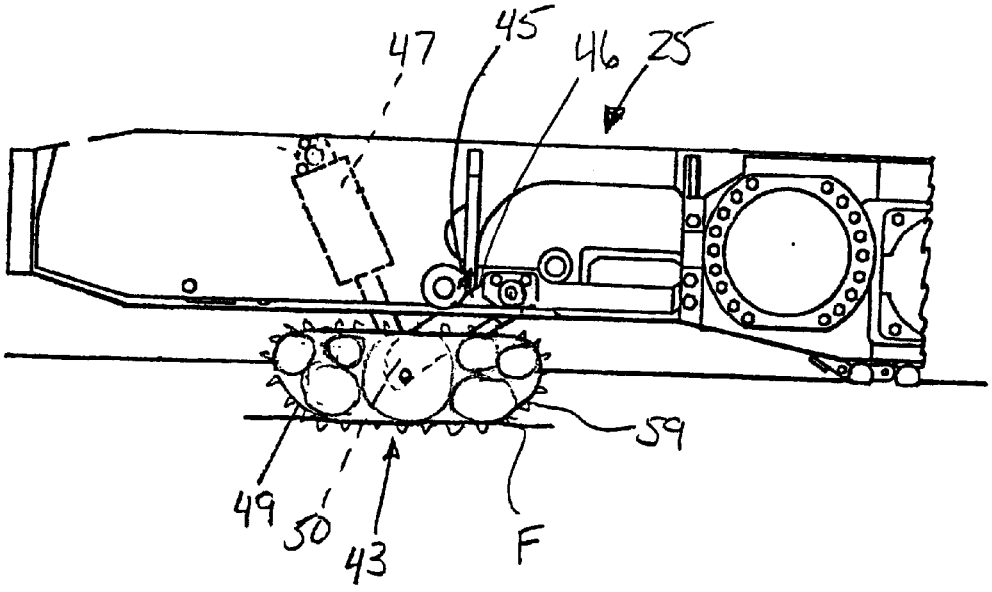
FIGS. 2A and 2B are right side and perspective views of a stabilizing apparatus according to an embodiment of the present invention.
Figure 2B:
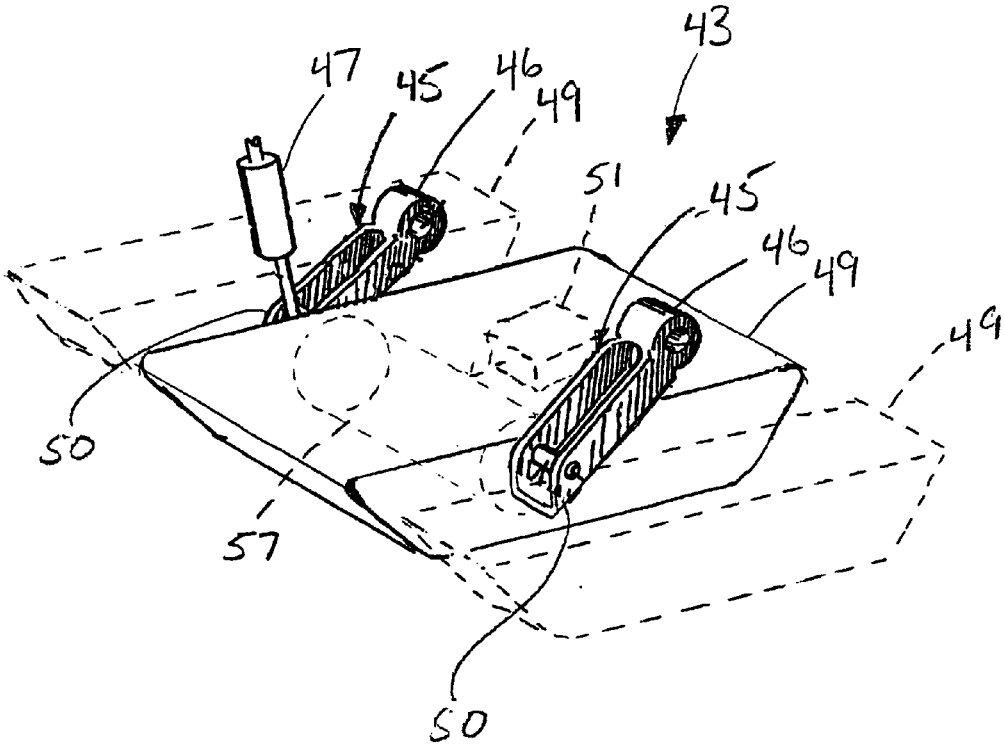

In typical mining machines, such as is seen in FIG. 1A, the conveyor assembly 31 includes a portion 53 that is pivotably attached to the rear end 33 of the main body portion 25 and another portion 55 that extends from a region near the front end 29 of the body portion behind the cutter drum 27 to the rear end 33 of the body portion and occupies a substantial portion of the space between the left and right sides 39, 41 of the body portion. In prior art arrangements, a stabilizing apparatus is ordinarily disposed beneath the conveyor assembly 31. The stabilizing apparatus 23 according to the present invention may also be disposed beneath the conveyor assembly 31, such as seen in FIGS. 1A, 1B, 2A, and 2B. As seen in FIGS. 2A and 2B, the turnable stabilizing element 43 may include a pair of endless crawler tracks 49 attached at the second end 50 of the moving arm, each one of the pair of endless crawler tracks of the turnable stabilizing element being disposed behind a corresponding one of the pair of endless drive tracks 35 and 37 (FIG. 1A).

Figure 3A:
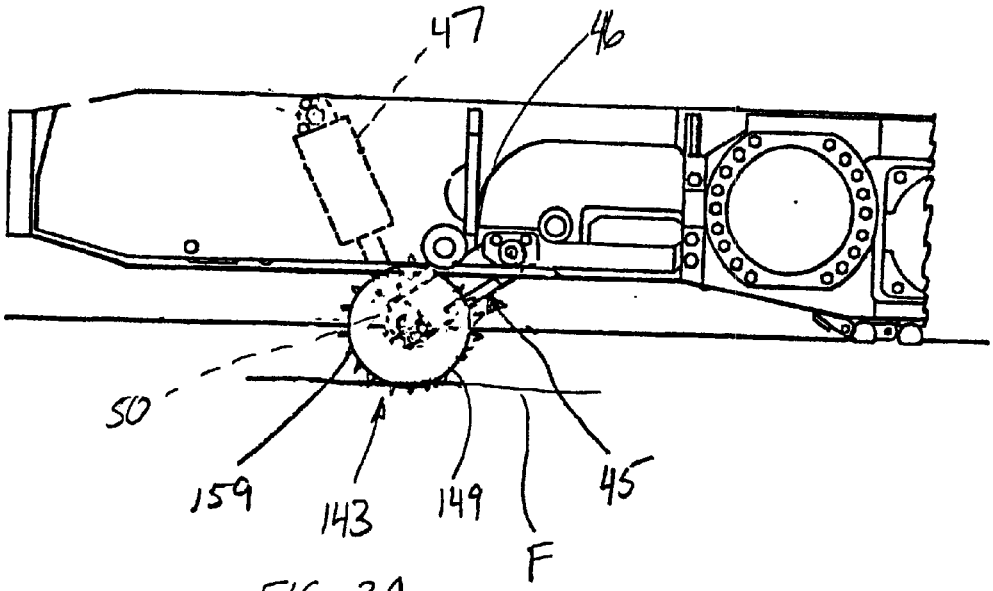
FIGS. 3A and 3B are right side and perspective views of a stabilizing apparatus according to another embodiment of the present invention.
Figure 3B:
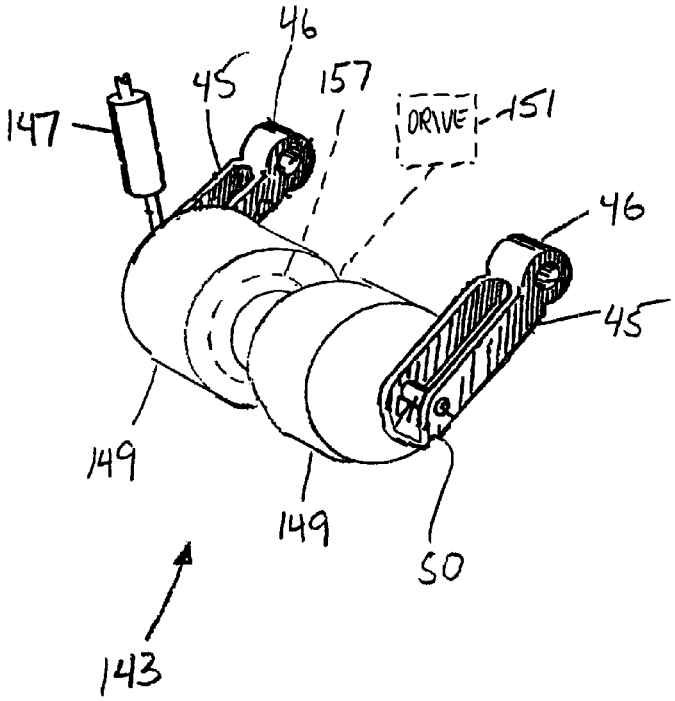

FIGS. 3A–3B show an embodiment of the mining machine with a stabilizing assembly wherein a turnable element 143 includes a rotatable drum 149 or drums. Like the crawler tracks 49, the drum 149 is preferably driven by a suitable drive 151. The drive 151 may be a dedicated drive or the drum 149 may be driven by the main drive for the mining machine 21. The drum 149 may also, like the crawler tracks 49, not be driven at all, if desired or necessary. The drum 149 is preferably provided with a clutch, such as a sprag clutch 157, to prevent reverse turning of the drum. The drum 149 may have outwardly extending teeth 159 to assist in advancing and/or preventing reverse movement of the mining machine 21.

Figure 5:
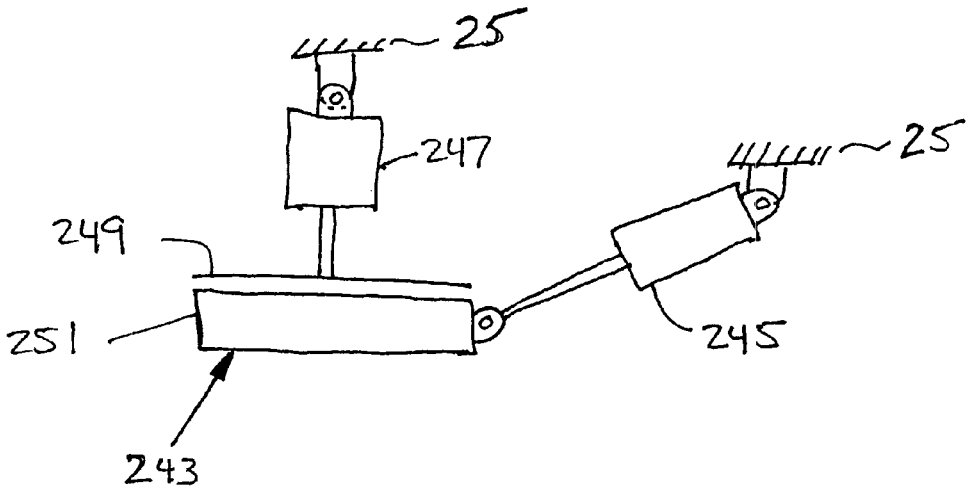
FIG. 5 schematically shows a mining machine having another stabilizing apparatus according to an embodiment of the present invention.

FIG. 5 shows another embodiment of the stabilizing apparatus 223. The stabilizing apparatus 223 is attached to the body 25 of the mining machine by means of a piston arrangement 247 that contacts a slide plate 249 of a stabilizing shoe assembly 243 and forces the stabilizing shoe assembly down relative to the body 25 of the mining machine. A second piston arrangement 245 is provided between the body 25 and a shoe portion 251 of the stabilizing shoe assembly for urging the shoe backward relative to the body of the mining machine to resist backward movement of the mining machine. When the second piston arrangement 245 urges the shoe portion 251 backward relative to the mining machine, the shoe portion is able to slide relative to the slide plate 249. The piston arrangements 245 and 247 each preferably include hydraulically operated pistons, and are each preferably pivotably mounted between the mining machine body 25 and the stabilizing shoe and the slide plate.

While this invention has been illustrated and described in accordance with a preferred embodiment, it is recognized that variations and changes may be made therein without departing from the invention as set forth in the claims.

What is claimed is:

1. A mining machine having a stabilizing apparatus, comprising:

a mining machine including a cutter drum that pivots downwardly during a mining operation; and a stabilizing apparatus attached to the mining machine, the stabilizing apparatus including a turnable stabilizing element and a moving arm attached to the turnable stabilizing element and the mining machine for raising the turnable stabilizing element above and lowering the turnable stabilizing element into contact with a mine floor during the mining operation.

2. The mining machine having a stabilizing apparatus as set forth in claim 1, wherein the moving arm is pivotably attached at a first end to the mining machine.

3. The mining machine having a stabilizing apparatus as set forth in claim 2, wherein the moving arm includes a control system for vertically pivoting the moving arm.

4. The mining machine having a stabilizing apparatus as set forth in claim 3, wherein the turnable stabilizing element includes at least one endless crawler track attached at a second end of the moving arm.

5. The mining machine having a stabilizing apparatus as set forth in claim 4, further comprising a drive arranged to drive the at least one endless crawler track.

6. The mining machine having a stabilizing apparatus as set forth in claim 4, wherein the turnable stabilizing element includes a pair of endless crawler tracks.

7. The mining machine having a stabilizing apparatus as set forth in claim 3, wherein the turnable stabilizing element includes at least one drum attached at a second end of the moving arm.

8. The mining machine having a stabilizing apparatus as set forth in claim 7, further comprising a drive arranged to drive the drum.

9. The mining machine having a stabilizing apparatus as set forth in claim 1, wherein the turnable stabilizing element includes at least one endless crawler track attached at an end of the moving arm.

10. The mining machine having a stabilizing apparatus as set forth in claim 9, further comprising a drive arranged to drive the at least one endless crawler track.

11. The mining machine having a stabilizing apparatus as set forth in claim 9, wherein the at least one endless crawler track is pivotable relative to the moving arm.

12. The mining machine having a stabilizing apparatus as set forth in claim 1, further comprising a conveyor portion, wherein the stabilizing apparatus is disposed beneath the conveyor portion.

13. The mining machine having a stabilizing apparatus as set forth in claim 1, wherein the mining machine includes a pair of endless drive tracks on left and right sides of the mining machine, and the wherein the turnable stabilizing element includes a pair of endless crawler tracks attached at an end of the moving arm, each one of the pair of endless crawler tracks of the turnable stabilizing element being disposed behind a corresponding one of the pair of endless drive tracks.

14. The mining machine having a stabilizing apparatus as set forth in claim 1, wherein the turnable stabilizing element includes at least one drum attached at an end of the moving arm.

15. The mining machine having a stabilizing apparatus as set forth in claim 14, further comprising a drive arranged to drive the drum.

16. The mining machine having a stabilizing apparatus as set forth in claim 1, wherein the stabilizing apparatus is pivotably attached to the mining machine, the mining machine further comprising a steering apparatus adapted to pivot the stabilizing apparatus relative to the mining machine.

17. A mining machine having a stabilizing apparatus, comprising:

a mining machine; and a stabilizing apparatus attached to the mining machine, the stabilizing apparatus including a turnable stabilizing element and a moving arm attached to the turnable stabilizing element and the mining machine for raising the turnable stabilizing element above and lowering the turnable stabilizing element into contact with a mine floor;

the moving arm is pivotably attached at a first end to the mining machine;

the moving arm includes a control system for vertically pivoting the moving arm;

the turnable stabilizing element includes at least one drum attached at a second end of the moving arm;

a drive arranged to drive the drum; and a clutch to prevent turning of the drum in a reverse direction.

18. A mining machine having a stabilizing apparatus, comprising:

a mining machine; and a stabilizing apparatus attached to the mining machine, the stabilizing apparatus including a turnable stabilizing element and a moving arm attached to the turnable stabilizing element and the mining machine for raising the turnable stabilizing element above and lowering the turnable stabilizing element into contact with a mine floor;

the turnable stabilizing element includes at least one drum attached at a second end of the moving arm;

a drive arranged to drive the drum; and a clutch to prevent turning of the drum in a reverse direction.

19. A mining machine having a stabilizing apparatus, comprising:

a mining machine; and a stabilizing apparatus attached to the mining machine, the stabilizing apparatus including a turnable stabilizing element and a moving arm attached to the turnable stabilizing element and the mining machine for raising the turnable stabilizing element above and lowering the turnable stabilizing element into contact with a mine floor; and at least one sensor for sensing a condition of the mining machine and a controller for controlling the moving arm, wherein the sensor is adapted to send a signal to the controller when the sensor senses the condition and the controller is adapted to cause the moving arm to raise the stabilizing element above the mine floor in response to the signal.

20. The mining machine having a stabilizing apparatus as set forth in claim 19, wherein the sensor senses an angle of tilt of the mining machine.

21. A stabilizing apparatus for a mining machine including a cutter drum that pivots downwardly during a mining operation, comprising:

a turnable stabilizing element; and a movable arm attached at a first end to the turnable stabilizing element and attached at a second end to a mining machine for raising the turnable stabilizing element above and lowering the turnable stabilizing element into contact with a mine floor during the mining operation.

22. The stabilizing apparatus for a mining machine as set forth in claim 21, wherein the moving arm is pivotably attachable at its second end to the mining machine.

23. The stabilizing apparatus for a mining machine as set forth in claim 22, wherein the turnable stabilizing element includes at least one endless crawler track attached at the first end of the moving arm.

24. The stabilizing apparatus for a mining machine as set forth in claim 23, further comprising a drive arranged to drive the at least one endless crawler track.

25. The stabilizing apparatus for a mining machine as set forth in claim 24, wherein the turnable stabilizing element includes a pair of endless crawler tracks.

26. The stabilizing apparatus for a mining machine as set forth in claim 24, wherein the at least one endless crawler track is pivotable relative to the moving arm.

27. The stabilizing apparatus for a mining machine as set forth in claim 22, wherein the turnable stabilizing element includes at least one drum attached at the first end of the moving arm.

28. The stabilizing apparatus for a mining machine as set forth in claim 27, further comprising a drive arranged to drive the drum.

29. A stabilizing apparatus for a mining machine, comprising:

a turnable stabilizing element; and a movable arm attached at a first end to the turnable stabilizing element and attached at a second end to a mining machine for raising the turnable stabilizing element above and lowering the turnable stabilizing element into contact with a mine floor;

the moving arm is pivotably attachable at its second end to the mining machine;

the turnable stabilizing element includes at least one drum attached at the first end of the moving arm;

a drive arranged to drive the drum; and a clutch to prevent turning of the drum in a reverse direction.

30. A mining machine having a stabilizing apparatus, comprising:

a mining machine including a cutter drum that pivots downwardly during a mining operation;

a stabilizing apparatus attached to the mining machine, the stabilizing apparatus including a stabilizing shoe portion; and a piston arrangement disposed between the stabilizing apparatus and a body of the mining machine, the piston arrangement being adapted to move the stabilizing shoe toward a rear of the body during the mining operation, wherein the stabilizing apparatus further includes a slide plate disposed above the stabilizing shoe, the slide plate and the stabilizing shoe being slidable relative to each other, wherein a second piston arrangement is disposed between the slide plate and the mining machine and is adapted to move the stabilizing shoe assembly downward relative to the body, and wherein the first and second piston arrangements are pivotably mounted between the stabilizing shoe and the body and the slide plate and the body, respectively.

31. A mining machine having a stabilizing apparatus, comprising:

a mining machine including a cutter drum that pivots downwardly during a mining operation;

a stabilizing apparatus attached to the mining machine; and a piston arrangement disposed between the stabilizing apparatus and a body of the mining machine, the piston arrangement being adapted to move the stabilizing apparatus downward relative to the body during the mining operation, wherein the stabilizing apparatus includes a surface member adapted to contact a floor of a mine and a drive member arranged to move the surface member relative to the body during the mining operation.

* * * * *